United States Patent [19]

Dupont

[11] 4,421,033

[45] Dec. 20, 1983

[54] EXERCISE PROJECTILE

[75] Inventor: Gérard E. Dupont, Doische, Belgium

[73] Assignee: s.a. PRB, societe anonyme, Brussels, Belgium

[21] Appl. No.: 298,107

[22] Filed: Aug. 31, 1981

[30] Foreign Application Priority Data

Sep. 19, 1980 [BE] Belgium ..... 2/58755

[51] Int. Cl.[3] ..... F42B 9/20

[52] U.S. Cl. ..... 102/529; 102/232; 102/234; 102/244; 102/248; 102/245

[58] Field of Search ..... 102/529, 502, 499, 498, 102/352, 444, 226, 472, 222, 489, 228, 231–233, 237, 238, 244, 245, 247, 248, 251, 254, 255

[56] References Cited

U.S. PATENT DOCUMENTS

| | | | |
|---|---|---|---|
| 2,857,845 | 10/1958 | Scavey | 102/204 |
| 2,948,219 | 8/1960 | Sapp | 102/204 X |
| 2,977,882 | 4/1961 | Lasse | 102/248 |
| 3,422,764 | 1/1969 | Kaiser | 102/233 |

FOREIGN PATENT DOCUMENTS

| | | |
|---|---|---|
| 416764 | 9/1934 | United Kingdom . |
| 445271 | 4/1936 | United Kingdom . |
| 773570 | 4/1954 | United Kingdom . |
| 708351 | 5/1954 | United Kingdom . |
| 899496 | 6/1962 | United Kingdom . |
| 985826 | 3/1965 | United Kingdom . |
| 1260109 | 1/1972 | United Kingdom . |
| 1274632 | 5/1972 | United Kingdom . |
| 1513745 | 6/1978 | United Kingdom . |
| 2028982 | 3/1980 | United Kingdom . |
| 1581108 | 12/1980 | United Kingdom . |

*Primary Examiner*—Harold J. Tudor
*Assistant Examiner*—Tyrone Davis
*Attorney, Agent, or Firm*—Bacon & Thomas

[57] ABSTRACT

Exercise projectile substantially of a configuration defined by a pointed head prolonged by a tail-piece, characterized in that the projectile contains at least one explosive charge and an associated device for delayed firing, the duration of the delay substantially corresponding to the statistical flight time of the projectile from its starting time to the end of its intended useful trajectory.

1 Claim, 8 Drawing Figures

EXERCISE PROJECTILE

BACKGROUND OF THE INVENTION

The present invention relates to an exercise projectile such as, for example, a projectile intended for artillery use in simulating anti-tank gunnery, and other related application.

The projectiles of this type are generally defined by a substantially pointed head prolonged by a tail-piece on which shoes are applied to bring the projectile up to the calibre of the gun used for shooting. These shoes become separated from the projectile as soon as it leaves the loop of the gun, the projectile itself following its intended trajectory. In anti-tank gunnery the trajectory is generally very flat, which significantly increases the risks of ricochets whenever the projectile misses the target or contacts it incorrectly, the problem being enhanced if the initial speed of such projectiles is high. In practicing anti-tank gunnery, a gunning ground must provide an extended safety zone at the rear target, the depth of which must be a multiple of the useful reach of the projectile. In many regions, gunnery grounds of this dimensional requirement are difficult or even impossible to establish.

SUMMARY OF THE INVENTION

The object of the present invention is to provide an exercise projectile capable of perfectly simulating a real projectile along the useful part of its trajectory, but the aerodynamic characteristics, specifically the position of the centre of gravity, of which is significantly modified at the end of the latter in order to considerably reduce its total reach.

For this purpose, the invention consists in providing in a part of the exercise projectile at least one explosive charge with which is associated a device for delayed firing, the duration of the delay substantially corresponding to the statistical duration of the flight of the projectile from the time of its discharge to the end of its desired useful trajectory.

BRIEF DESCRIPTION OF THE DRAWINGS

For more clearness, an example of a preferred embodiment of the invention is described herein after, illustratively and not restrictively, reference is made to the attached drawings, in which.

DETAILED DESCRIPTION OF THE PREFERRED EMBODIMENT

Figure 1:
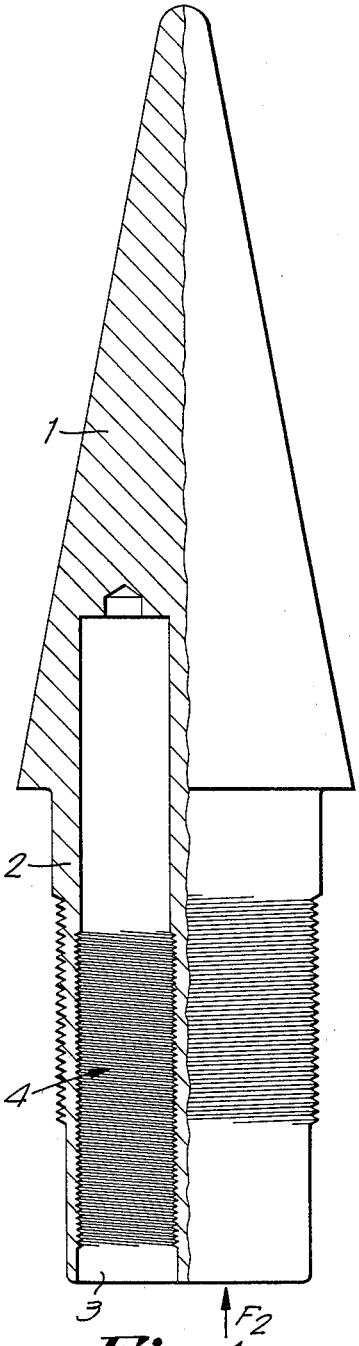
FIG. 1 is a side view of a projectile according to the invention, with a schematical half section.
Figure 4:
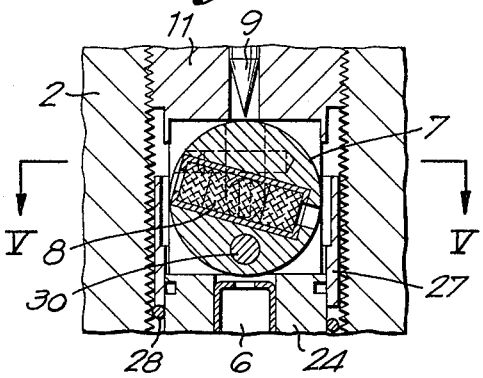
FIG. 4 is a more detailed section, at a greater scale, of the part indicated as F4 on FIG. 3.
Figure 5:
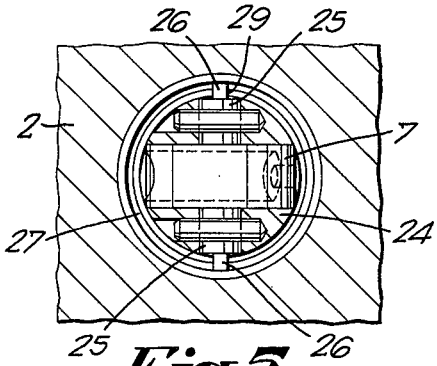
FIG. 5 is a section according to line V—V of FIG. 4.
Figure 2:
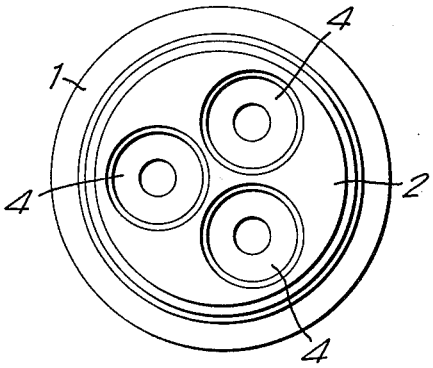
FIG. 2 is a view according to the arrow F2 of FIG. 1.
Figure 3:
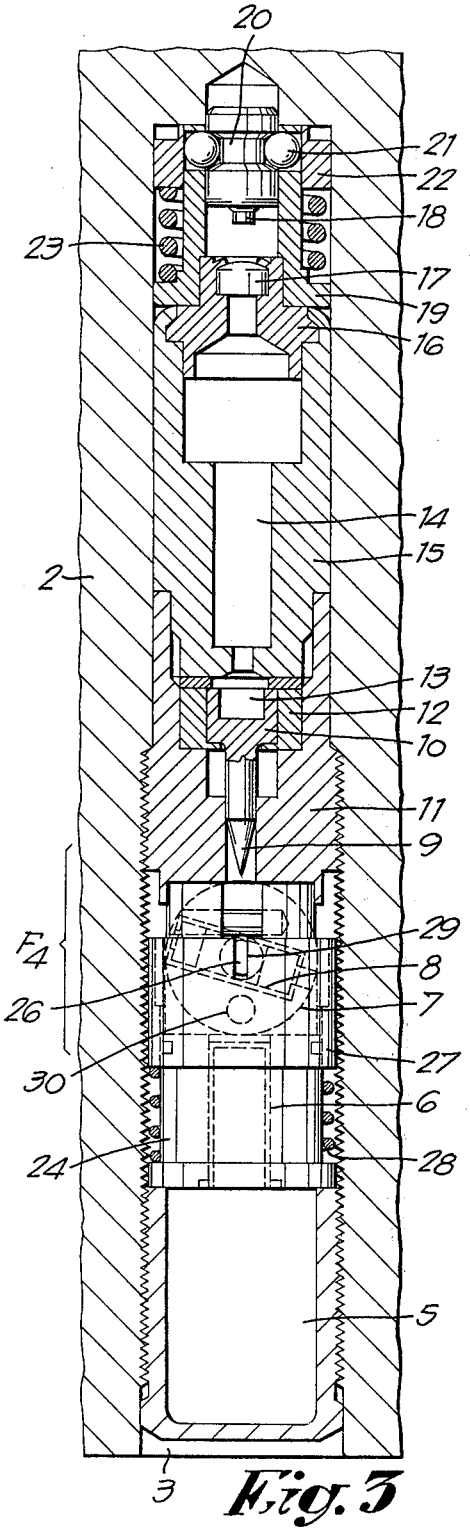
FIG. 3 is an axial section of an assembly constituted by an explosive charge and its delaying device equipping the projectile according to FIG. 1 at rest.

The projectile according to FIG. 1 is made up of a more or less pointed head 1 prolonged by a tail-piece 2. In the latter are provided three recessed bores 3, the axes of which are parallel to the axis of the projectile and mutually spaced at 120°. In each of these bores is housed an assembly 4 constituted by an explosive charge and a delayed-firing device. These assemblies 4 being mutually identical, only one shall be hereinafter described.

Generally, an assembly 4 comprises a main explosive charge 5, the firing chain of which comprises a relay 6, a pyrotechnical switch constituted by a rotor 7 containing a percussion detonator 8 and a striker 9 carried at the end of a piston 10, which is kept at rest in a striker-guide 11 by means of a retaining cap 12.

The piston 10 has a recessed bore containing an explosive charge 13, consisting, for example, of lead dinitroresorcinate.

Above the charge 13 there is provided a delaying charge 14 compressed in a tubular casing 15.

A percussion cap 16 contains a primer 17 that can be fired by a striker 18 carried by a guide-bush 19.

The striker 18 has a peripheral groove 20 in which are partially housed three balls 21, which are supported, on the edge of the aforesaid guide-bush 19 and on a sliding ring 22, the latter being mounted on a helical spring 23.

The rotor 7 is rotatably mounted in a rotor-carrier 24 by means of two pins 25 with flat ends 26. A sliding ring 27 surrounds the body of the rotor-carrier 24 and is forced back towards its safety position by a spring 28, a position in which the flat ends 26 enter into slots 29 provided for this purpose in the aforesaid ring 27. In this safety position, the detonator 8 is out of line with respect to the firing chain of the charge 5. This rotor carries an eccentric weight 30. The aforesaid device functions as follows.

Figure 7:
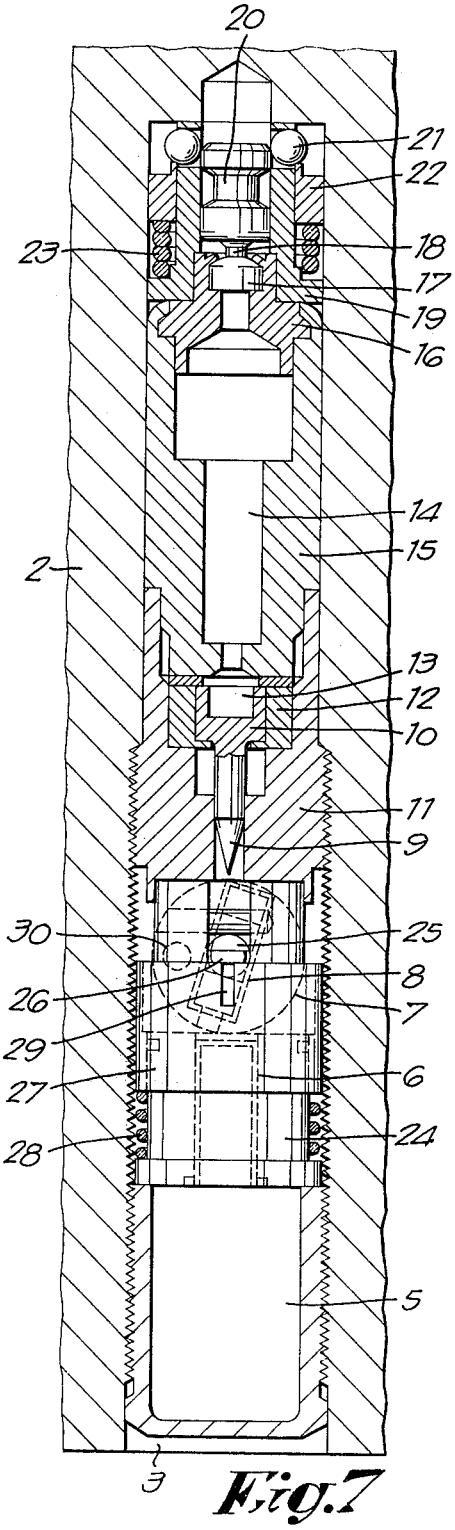

When there is an acceleration which is sufficient and has a corresponding firing, the ring 22 compresses, through inertia, the spring 23 and releases the balls 21, which are displaced radially from the groove 20, releasing the striker 18. If the acceleration continues at this moment, the striker 18 strikes the primer 17 with an energy which is sufficient to fire same as shown in FIG. 7.

Figure 6:
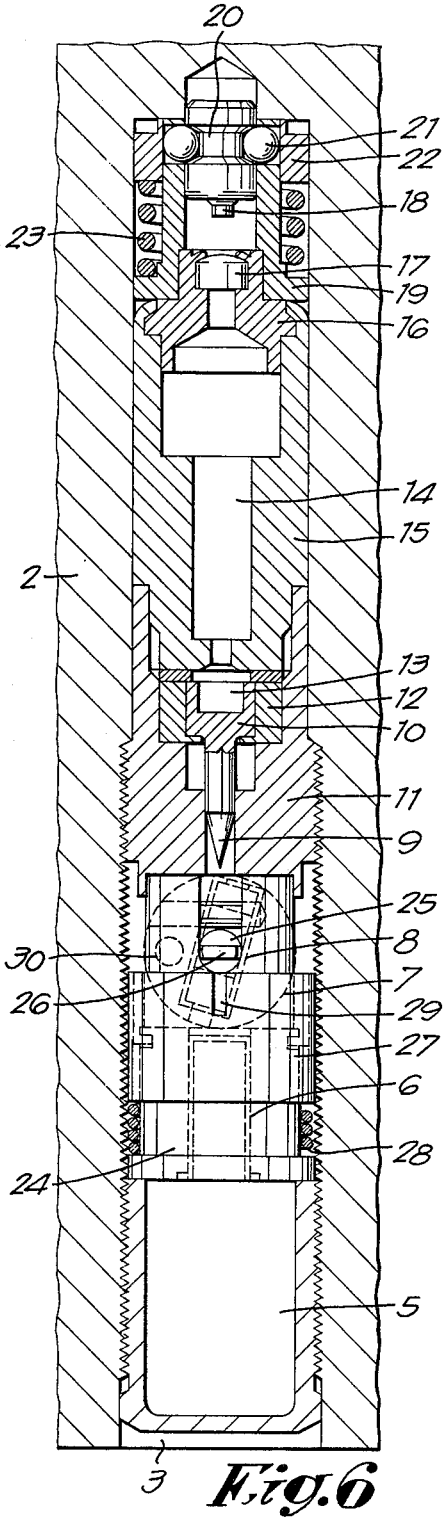
FIGS. 6 to 8 are views similar to the one of FIG. 3, representing, however, the assembly at three successive stages of its functioning.

The primer 17 ignites the charge 14, which, in the present instance, burns in two seconds. At the end of this combustion, the flame emerging from the tubular casing 15 ignites the charge 13, which results in the fracturing of the retaining cap 12 by the rearward displacement of piston 10. The ring 27 having previously compressed the spring 28 has released the rotor 7, which has come into active position, due to the action of the centrifugal force on its eccentric weight 30, as shown in FIG. 6.

Figure 8:
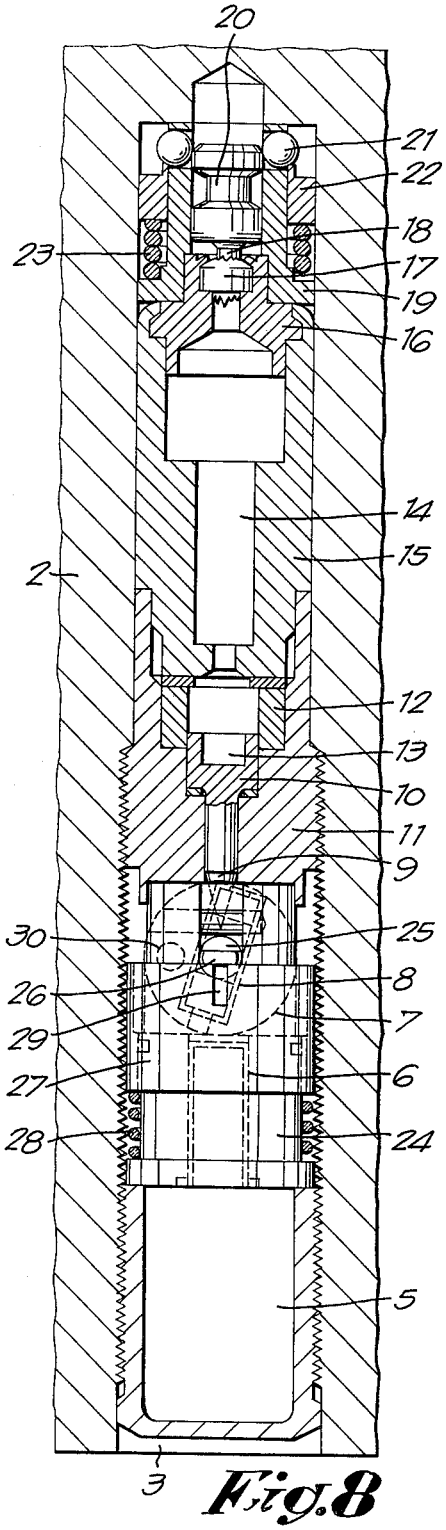

The detonator 8 is thus struck by the striker 9, which results in the firing of the charge 5, via the relay 6, as shown in FIG. 8.

The calibration of the spring 23 is selected so that even a strong acceleration of short duration shall not allow the ring 22 to travel over the distance necessary for releasing the balls.

In an example of the invention in practice, the calibration of the spring 23 was such that a fall of the projectile over a distance of 12 meters was insufficient to bring about the liberation of the striker 18.

The double safety procured by the arrangement of the striker-piston 9 and 10 is also of advantage. No hot gas can escape from the tubular casing 15 when the charge 14 is burning, which ensures that the detonator 8 shall not ignite if it is not be correctly aligned.

In another consideration, if the charge 14 is omitted in production, the primer 17 would probably ignite the charge 13, but the resulting pressure would be insufficient to break the cap 12 because the volume available at that time for the expansion of the gases would be much more than under proper operation condition.

In the aforedescribed embodiment, three assemblies 4 are provided for safety reasons. It is certain that one of the charges 5 will explode with the required timing, and this explosion will result in the explosion of the two other charges, due to their proximity.

These explosions result in a partial destruction of the projectile, at the level of its centre of gravity, resulting in an important slowing down and a premature end of the trajectory.

It is clear that a great number of changes may be brought to the preferred embodiment described herein, without departing from the scope of the invention as defined by the subjoined claims herein after.

I claim:

1. In a practicing projectile having a head and including at least one explosive charge having associated therewith at least one delayed firing device, the improvement comprising:

(a) first and second coaxial pyrotechnic chains positioned one behind the other between the head and the charge;

(b) the first chain including:

1. a first striker,
2. a first locking means securing the first striker and releasing same when subjected to the joint effect of projectile acceleration and centrifugal force developed when the projectile is fired,
3. a primer,
4. a delaying charge, and
5. an explosive propulsive charge;

(c) the second chain including:

1. a second striker,
2. a second locking means for securing the second striker and releasing and permitting same to be propelled when the explosive propulsive charge is fired;

(d) a pyrotechnic switch including:

1. a rotor having two pins with flat ends,
2. a rotor carrier rotatably mounting the rotor, and
3. a detonator carried by the rotor; and (e) a third locking means including:

1. a spring,
2. a slidable ring surrounding the rotor carrier and including slots for receiving the flat ends of the pins, and
3. the slidable ring being maintained in an operative position by the spring for securing the rotor, and being brought into an inoperative position for releasing the rotor through the action of the accleration force, during which the rotor is rotated to align the detonator with the striker through the action of the centrifugal force.

* * * * *